United States Patent [19]

Kimura et al.

[11] Patent Number: 4,502,032

[45] Date of Patent: Feb. 26, 1985

[54] EBULLITION COOLED TRANSFORMER

[75] Inventors: Minoru Kimura, Itami; Hisamitsu Takahashi, Takarazuka, both of Japan

[73] Assignee: Mitsubishi Denki Kabushiki Kaisha, Tokyo, Japan

[21] Appl. No.: 580,637

[22] Filed: Feb. 16, 1984

[30] Foreign Application Priority Data

Apr. 21, 1983 [JP] Japan ..... 58-71305

[51] Int. Cl.[3] ..... H01F 27/10

[52] U.S. Cl. ..... 336/58; 165/104.27; 174/12 R; 174/15 R

[58] Field of Search ..... 174/12 R, 14 R, 15 R; 165/104.27; 336/55, 57, 58, 59, 61

[56] References Cited

U.S. PATENT DOCUMENTS

| | | | |
|---|---|---|---|
| 1,759,971 | 5/1930 | Austin | 174/12 R |
| 3,229,023 | 1/1966 | Bolton et al. | 174/14 R |
| 4,106,557 | 8/1978 | Sonobe et al. | 165/104.27 |
| 4,253,518 | 3/1981 | Minesi | 336/58 X |
| 4,330,033 | 5/1982 | Okada et al. | 336/58 X |

OTHER PUBLICATIONS

Apparatus for Continuously Monitoring Hydrogen Gas Dissolved in Transformer Oil IEEE Transactions on Electrical Insulation, vol. EI-16, No. 6, Dec. 1981, pp. 504 and 505.

H. Tsukioka et al., "Application of High Molecular Membrane as Means for Separating Gases From Oil Papers S of the Institute of Electrical Engineering of Japan, vol. 102, No. 5, May, 1982, pp. 41 and 48.

*Primary Examiner*—Thomas J. Kozma

*Attorney, Agent, or Firm*—Wenderoth, Lind & Ponack

[57] ABSTRACT

An ebullition cooled transformer has a housing, a core and coil assembly disposed on the lower portion of the housing to be immersed into a condensible electrically insulating refrigerant, a cooler unit located above the core and coil assembly within the housing, and a communicating tube disposed at the top of the housing to communicate with the outside air and provided with a porous filter permitting the air to permeate it but preventing a vapor of the refrigerant from permeating it.

3 Claims, 2 Drawing Figures

EBULLITION COOLED TRANSFORMER

BACKGROUND OF THE INVENTION

This invention relates to an ebullition cooled transformer and more specifically to an ebullition cooled transformer using a condensible, liquid as an electrically insulating, cooling medium.

A conventional ebullition cooled transformer of the type referred to has comprised a core and coil assembly consisting of an iron core and a low and a high voltage coil inductively disposed around the iron core, a housing including a low portion on which the core and coil assembly is fixedly disposed by having one end of the iron core fixed to the bottom thereof, an amount of a condensible, electrically insulating, refrigerant charged into the lower portion of the housing to substantially immerse the core and coil assembly thereinto, and a cooler unit disposed on an upper portion of the housing which is filled with a vaporized portion of the refrigerant.

In operation, the core and coil assembly generates heat to boil the refrigerant. The resulting vapor is raised toward the cooler. The cooler unit exchanges heat between the vapor of the refrigerant and the outside air to condense the vapor of the refrigerant into drops of the refrigerant in the liquid phase. Thus the drops of the refrigerant fall on the refrigerant in the liquid phase disposed on the lower portion of the housing. The process as described above is repeated to continuously cool the core and coil assembly.

Also in view of the economy, the housing is not constructed to form a pressure container. In other words, the atmospheric pressure or less is the highest pressure under which the housing can be put. Thus it is a common practice to use condensible electrically insulating refrigerants having the temperature-to-pressure charactristic suitable under such a pressure or less. An example of those refrigerants involves a fluorocarbon expressed by $C_8F_{16}O$ which has a vapor pressure on the order of 1 kg/cm$^2$ abs at 100° C. However, that fluorocarbon has a vapor pressure of, about 10 mmHg at 0° C. That is, the vapor pressure is extremely low in a low temperature range. Also the vaporized portion of the fluorocarbon located above the core and coil assembly within the housing has a dielectric breakdown field of about 1.6 r.m.s. kV/mm which figure is low as compared with the air under one atmospheric pressure. Thus the fluorocarbon as described above is bubbled when a load is applied to the transformer put at a low temperatures. The bubbles thus formed at the low temperature are low in vapor pressure and therefore dielectric strength. Under these circumstances, therefore, it has been required to maintain a sufficient electrically insulating distance in each of the liquid and vapor phases in order to prevent the dielectric breakdown or partial electric discharges from occurring. Thus transformer of the type referred to have encountered a problem in the cancellation of the advantages that a thermal flux is large due to the heat transfer resulting from ebullition cooling and the associated coils can be made small-sized.

Accordingly it is an object of the present invention to provide a new and improved ebullition cooled transformer capable of preventing a dielectric strength from decreasing at low temperatures and of maintaining a considerable dielectric strength in the atmosphere.

SUMMARY OF THE INVENTION

The present invention provides an ebullition cooled transformer comprising a housing, a core and coil assembly fixed disposed on a lower portion of the housing, an amount of a condensible electrically insulating refrigerant charged into the lower portion of the housing to immerse the core and coil assembly therein, a cooler unit disposed above the core and coil assembly within the housing, a communicating tube disposed at a top of the housing to communicate with the outside air, and a filter disposed in the communicating tube to permit the air to permeate the same but prevent a vapor of the condensible electrically insulating refrigerant from permeating the same.

Preferably the filter may be composed of a porous film of high molecular, tetrafluoride ethylene.

BRIEF DESCRIPTION OF THE DRAWING

The present invention will become more readily apparent from the following detailed description taken in conjunction with the accompanying drawing in which.

DESCRIPTION OF THE PREFERRED EMBODIMENTS

Figure 1:
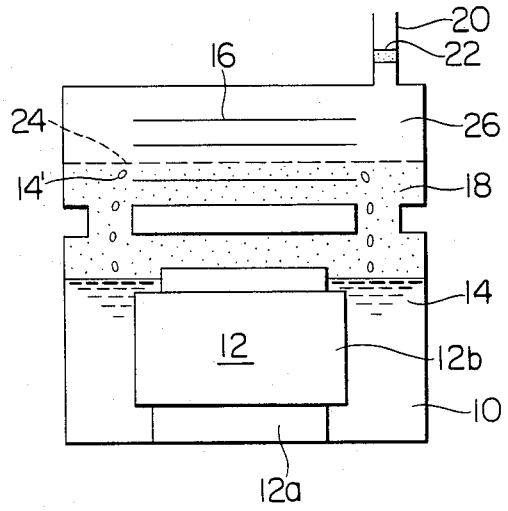
FIG. 1 is a front elevational view of one embodiment according to the ebullition cooled transformer of the present invention with parts cut away to illustrate the internal structure thereof.

Referring now to FIG. 1 of the drawing, there is illustrated one embodiment according to the ebullition cooled transformer of the present invention. The arrangement illustrated comprises a housing 10 in the form of a rectangular box constricted with an intermediate portion thereof, a core and coil assembly generally designated by the reference numeral 12 including an iron core **12*a* and a low and a high voltage coil 12*b* wound around the iron core 12*a* and disposed within the housing 10 by having the lower end as viewed in FIG. 1 of the iron core 12*a* fixed to the inner bottom of the housing 10, and an amount of a condensible electrically insulating refrigerant 14 charged into the housing 10 so as to immerse the core and coil assembly 12 thereinto except for the upper portion of the iron core 12*a*. The arrangement comprises further a cooler unit 16 disposed above the core and coil assembly 12 within the housing 10**.

A structure as described above is well known in the art and the housing 10 has been used under at most one atmospheric pressure as described above. Thus a fluorocarbon expressed by $C_8F_{16}O$ is commonly used as the condensible, electrically insulating refrigerant 14. In operation, the housing 10 is filled with a vaporized portion of the abovementioned fluorocarbon except for a space occupied by both the refrigerant or fluorocarbon 14 in the liquid phase and the core and coil assembly 12. Accordingly, there has been caused the abovementioned problem. That is to say, the ebullition cooled transformer has been deprived of the advantages that a thermal flux is large due to the heat transfer resulting from ebullition cooling and the associated coils can be made small-sized.

The present invention contemplates to solve the problems as described above by the provision of a communicating tube disposed at the top of the housing to selectively permeate the air alone therethrough whereby the dielectric strength is prevented from decreasing at low temperatures and a considerable dielectric strength can be maintains in the atmosphere while the abovementioned advantages are retained.

As shown in FIG. 1, a communicating tube 20 is disposed at the top of the housing 10 to permit the interior thereof to communicate with the outside air therethrough and a porous filter 22 is disposed in a passageway defined by the tube 20. The porous filter 22 is formed of a porous film including a multitude of small pores sized enough to permit molecules composing the air to permeate the filter 22 but to prevent vapor molecules of the condensible electrically insulating refrigerant 14, in this case, fluorocarbon expressed by $C_8F_{16}O$ from permeating the filter 22. That is, the filter 22 is preferably formed of poly-tetrafluoroethylene.

Initially the housing 10 is substantially filled with the air introduced thereinto through the communicating tube 20 and the porous filter 22 except for the space occupied by both the refrigerant 14 in the liquid phase and the core and coil assembly 12 because the refrigerant 14, in this case, the abovementioned fluorocarbon has a low vapor pressure at low temperatures.

In operation the core and coil assembly 12 generates heat to vaporize the refrigerant 14. It is noted that the fluorocarbon as described above does not form bubbles therein unless it is put under a pressure not less than the atmospheric pressure. Since a vapor of the abovementioned fluorocarbon is heavier than the air by ten times or more a boundary surface 24 is developed on the upper portion of the housing 10 to traverse the cooler unit 16 to separate the vaporized portion 18 of the fluorocarbon located on the lower side thereof from an air layer 26 located on the upper side thereof. Although the air is mixed with the vapor of the fluorocarbon through thermal motion of gaseous molecules, the vaporized portion 18 is separated from the air layer 26 by the boundary surface 24 while each of them has a purity of not less than 95% at a temperature ranging about 90° to about 100° C.

Thus that portion located under the boundary surface 24 as viewed in FIG. 1 of the cooler unit 16 condenses the vaporized portion of the fluorocarbon into drops 14 thereof and therefore performs the cooling operation.

Figure 2:
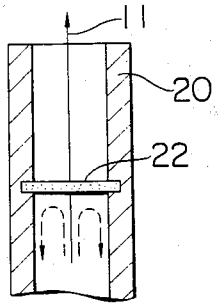
FIG. 2 is a longitudinal sectional view in an enlarged scale of the communicating tube shown in FIG. 1.

When the fluorocarbon or refrigerant 14 rises in vapor pressure, the air layer 26 pushes up by means of the increased vapor pressure of the refrigerant 14 and therefore, the air included in the air layer 26 is exhausted to the outside of the housing 10 through the communicating tube 20 and the porous filter 22 as shown at the solid arrow 28 in FIG. 2. At that time the vapor portion of the abovementioned fluorocarbon may be partly caught by the stream of the air shown at the solid arrow 28 but it is returned back to the interior of the housing by the porous filter 22 as shown at the dotted arrow in FIG. 2. Finally, the vaporized portion 18 of the refrigerant 14 reaches a vapor pressure as determined by a temperature of the refrigerant 14 at that time whereupon the air is stopped to be exhausted through the communicating tube 20.

On the other hand, when the refrigerant 14 decreases in vapor pressure, the interior of the housing 10 has a negative pressure. Thus, the outside air is introduced into the housing 10 through the communicating tube 20 and the porous filter 22 until the outside air is not introduced into the housing 10 when the vaporized refrigerant portion 18 reaches a vapor pressure as determined by a temperature of the refrigerant 14 at that time.

From the foregoing it is seen that, even during bubbling the abovementioned fluorocarbon at low temperatures, the dielectric strength developed under the atmospheric pressure is always obtained. Thus the high voltage portion can be made compact.

In summary the present invention provides an ebullition cooled transformer including a communicating tube permitting only air to be selectively introduced into and exhausted from the interior of housing in response to a vapor pressure of a condensible electrically insulating refrigerant disposed in the interior of the housing. Therefore, the present invention can very improve the partial electric discharge and the dielectric strength characteristics at low temperatures without an electrically insulating distance increased.

While the present invention has been illustrated and described in conjunction with a single preferred embodiment thereof it is to be understood that numerous changes and modifications may be resorted to without departing from the spirit and scope of the present invention.

What is claimed is:

1. An ebullition cooled transformer comprising a housing, a core and coil assembly fixedly disposed on a lower portion of said transformer, an amount of a condensible electrically insulating refrigerant charged into the lower portion of said housing to immerse said core and coil assembly therein, a cooler unit disposed above said core and coil assembly within said housing, a communicating tube disposed at a top of said housing to communicate with the outside air, and a filter disposed in said communicating tube to permit the air to permeate the same but prevent a vapor of said condensible electrically insulating refrigerant from permeating the same.

2. An ebullition cooled transformer as claimed in claim 1 wherein said filter is formed of a porous film of tetrafluoride ethylene.

3. An ebullition cooled transformer as claimed in claim 1 wherein said condensible electrically insulating refrigerant comprises a fluorocarbon expressed by $C_8F_{16}O$.

* * * * *